US007210458B2

(12) United States Patent
Walther et al.

(10) Patent No.: US 7,210,458 B2
(45) Date of Patent: May 1, 2007

(54) DEVICE AND METHOD FOR DETERMINING PRESSURE FLUCTUATIONS IN A FUEL SUPPLY SYSTEM

(75) Inventors: Jochen Walther, Stuttgart (DE); Oliver Schulz, Stuttgart (DE); Oliver Becker, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/281,712

(22) Filed: Nov. 16, 2005

(65) Prior Publication Data

US 2006/0130569 A1 Jun. 22, 2006

(30) Foreign Application Priority Data

Nov. 25, 2004 (DE) ..... 10 2004 056 893

(51) Int. Cl.
*F02M 57/02* (2006.01)
*F02M 57/00* (2006.01)

(52) U.S. Cl. ..... 123/446; 123/456

(58) Field of Classification Search ..... 123/446, 123/456, 447, 457, 458, 472, 478; 73/119 A
See application file for complete search history.

(56) References Cited

U.S. PATENT DOCUMENTS 5,803,047 A * 9/1998 Rask ..... 123/406.37
5,848,583 A * 12/1998 Smith et al. ..... 123/497
6,138,638 A * 10/2000 Morikawa ..... 123/295

FOREIGN PATENT DOCUMENTS

DE 102 17 592 4/2002

* cited by examiner

*Primary Examiner*—Mahmoud Gimie
(74) *Attorney, Agent, or Firm*—Kenyon & Kenyon LLP

(57) ABSTRACT

A device and a method for determining pressure fluctuations in a fuel supply system provide two signal filters to enable determining as much information about pressure fluctuations as possible with minimal sensor use. A sensor signal which is characteristic of a pressure in the area of a fuel injector is filtered using the two filters, which have filter characteristics that differ from one another.

12 Claims, 2 Drawing Sheets

DEVICE AND METHOD FOR DETERMINING PRESSURE FLUCTUATIONS IN A FUEL SUPPLY SYSTEM

FIELD OF THE INVENTION

The present invention relates to a device and a method for determining pressure fluctuations in a fuel supply system including, e.g., a fuel injector.

BACKGROUND INFORMATION

Utilization of the sensor effect of the piezoelectric actuator for measuring the frequency of a pressure wave, which is generated by the opening and closing of the nozzles, is described in published German patent document DE 102 17 592, for example. The piezoelectric actuator is used to open and close the control valve of the fuel injector in order to control the injection operation. The fact that the piezoelectric actuator is able to convert electric voltage into force and electric charge into linear expansion is utilized for this purpose. The reversal of these effects is utilized to convert the mechanical force exerted on the piezoelectric actuator into an electrical voltage signal. This is known as the sensor effect.

SUMMARY OF THE INVENTION

The device and the method according to the present invention for determining pressure fluctuations in a fuel supply system provide a first filter and a second filter, to which filters a signal characterizing the pressure in the area of the first fuel injector is supplied, the first filter having a first filter characteristic and the second filter having a second filter characteristic which differs from the first filter characteristic. This arrangement makes it possible to filter the signal characterizing the pressure in the area of the first fuel injector in different ways, so that different information for processing may be obtained from the signal. The signal characterizing the pressure in the area of the first fuel injector is thus able to be analyzed in various ways.

It is particularly advantageous when a first limiting frequency of the first filter is selected in such a way that it is higher than first frequencies of low-frequency pressure fluctuations to be anticipated due to the fuel delivery by a fuel pump and/or low-frequency pressure fluctuations to be anticipated due to a pressure drop during at least one injection operation, a pass-band of the first filter below the first limiting frequency being selected in such a way that it includes the first frequencies. In this way, information about possible low-frequency pressure fluctuations due to the fuel delivery by the fuel pump, and/or due to a pressure drop during at least one injection operation, may be obtained in a targeted manner from the signal characterizing the pressure in the area of the first fuel injector, i.e., the information about possible low-frequency pressure fluctuations is differentiated or separated from other information in this signal. In addition, further processing of the filtered information of the signal characterizing the pressure in the area of the first fuel injector, obtained via the first filter, may be performed.

It is also advantageous when a limiting frequency of the second filter is selected in such a way that it is lower than a second frequency or second frequencies of high-frequency pressure fluctuations to be anticipated which occur during an injection operation of the first fuel injector, a pass-band of the second filter above the second limiting frequency being selected in such a way that it includes the second frequency or the second frequencies. In this way, information about high-frequency pressure fluctuations due to an injection operation of the first fuel injector may be determined from the signal characterizing the pressure in the area of the first fuel injector, and differentiated or separated from information of the signal characterizing the pressure in the area of the first fuel injector. The information of the signal characterizing the pressure in the area of the first fuel injector, obtained via the second filter, may then also be conveyed for suitable further processing in a targeted manner.

The two filters may be implemented in a simple manner if the first filter is designed as a low-pass or band-pass filter and the second filter is designed as high-pass or band-pass filter.

A further advantage arises if a control unit is provided to which a first output signal of the first filter is supplied and which controls the pressure in a fuel line of the fuel supply system as a function of the first output signal. In this way, the information of the signal characterizing the pressure in the area of the first fuel injector, obtained from the first filter, may be used for regulating the pressure in the fuel line of the fuel supply system.

A further advantage arises if a determination unit is provided to which a second output signal of the second filter is supplied and which determines a sound velocity of the fuel as a function of the second output signal. In this way, the information of the signal characterizing the pressure in the area of the first fuel injector, obtained from the second filter, may also be analyzed, e.g., in order to determine an error in the injected fuel quantity and to increase the metering accuracy of the fuel supply.

It is also advantageous if at least one sensor is provided which generates a signal as a function of an existing pressure, the at least one sensor being situated in the area of the first fuel injector. In this way, the pressure may be determined at a point of the fuel supply system at which the pressure includes a representative part of the low-frequency pressure characteristic in a common fuel supply due to the fuel supply by the fuel pump and/or due to the pressure drop during at least one injection operation of the first fuel injector, as well as a representative part of the high-frequency pressure characteristic in a fuel line between the common fuel supply and the first fuel injector, this high-frequency pressure characteristic being a function of the injection operation of the first fuel injector. The low-frequency part and the high-frequency part of the signal characterizing the pressure in the area of the first fuel injector, determined by the sensor, may be separated from one another using the two filters and may be conveyed for suitable further processing.

DETAILED DESCRIPTION

Figure 1:
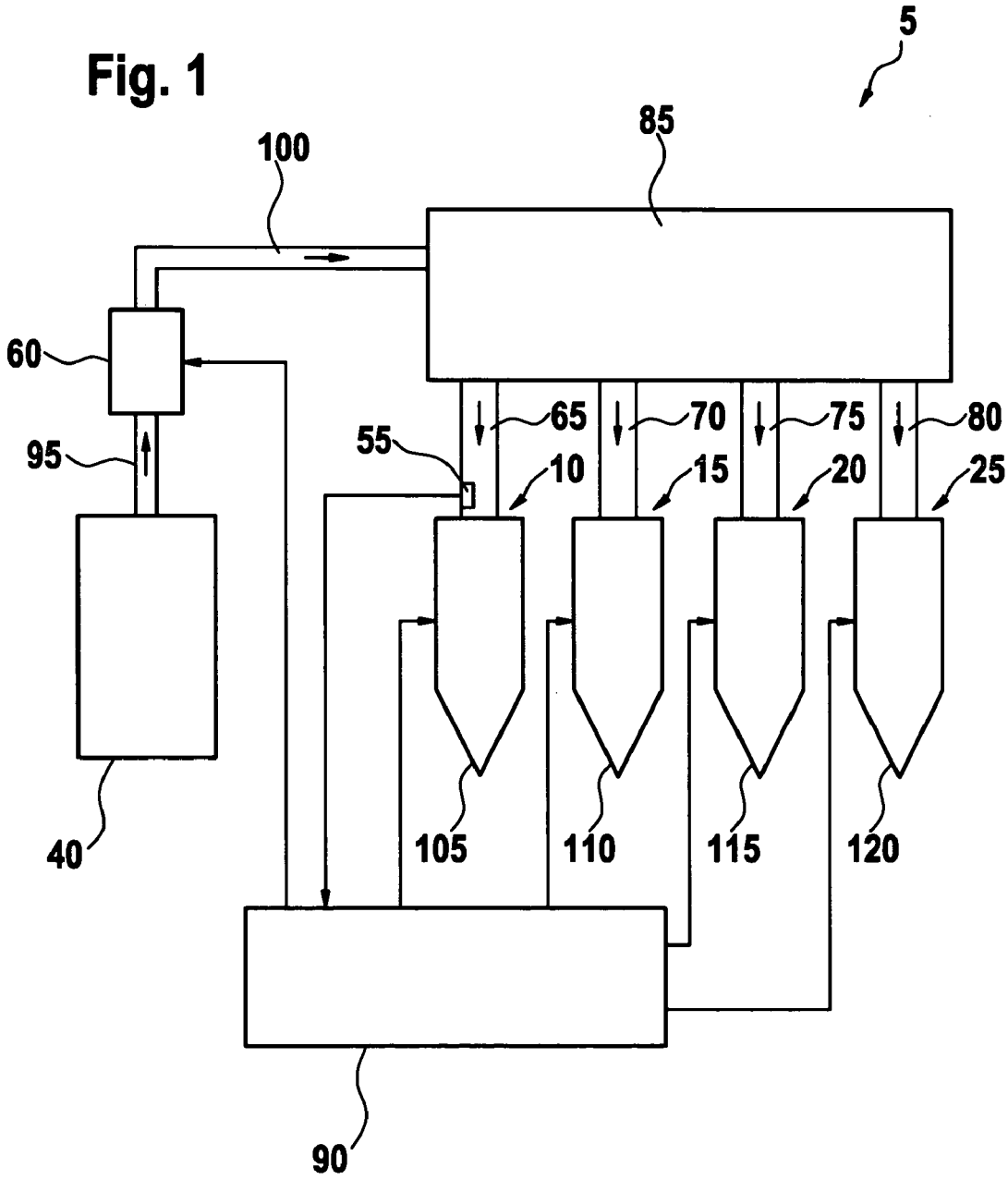
FIG. 1 shows a schematic illustration of a fuel supply system.

In FIG. 1, reference numeral 5 indicates a fuel supply system, e.g., of a motor vehicle. Fuel supply system 5 supplies, for example, a combustion chamber of an engine with fuel, diesel fuel in the present example, via at least one injection valve, which is also referred to as a fuel injector. According to the example in FIG. 1, four fuel injectors 10, 15, 20, 25 are provided which directly inject the fuel into assigned cylinders of the engine (not shown in FIG. 1 for the sake of clarity). A high pressure pump 40, having an upstream fuel metering unit (not shown in FIG. 1 for the sake of clarity), supplies fuel from a fuel tank (also not shown in FIG. 1) via a first fuel line 95, a pressure regulation valve 60, and a second common fuel line 100 to what is known as a rail 85 which represents a third common fuel line in the form of a fuel pressure container and distributes the supplied fuel to individual fuel injectors 10, 15, 20, 25 via fuel lines 65, 70, 75, 80, respectively. Pressure regulation valve 60 could alternatively also be situated on rail 85 or on high pressure pump 40. Individual fuel lines 65, 70, 75, 80 are high pressure lines. Fuel is supplied from rail 85 to a first fuel injector 10 via a first fuel line 65; to a second fuel injector 15 via a second fuel line 70; to a third fuel injector 20 via a third fuel line 75; and to a fourth fuel injector 25 via a fourth fuel line 80. First fuel injector 10 includes a nozzle 105 via which fuel is directly injected into a first cylinder. Second fuel injector 15 includes a second nozzle 110 via which fuel is directly injected into a second cylinder. Third fuel injector 20 includes a third nozzle 115 via which fuel is directly injected into a third cylinder. Fourth fuel injector 25 includes a fourth nozzle 120 via which fuel is directly injected into a fourth cylinder. As described in FIG. 1, the four cylinders are not shown for the sake of clarity. Fuel could alternatively be injected into a cylinder via multiple fuel injectors. Intake manifold fuel injection may alternatively be considered for direct injection, in a gasoline engine in particular.

Continuing with FIG. 1, a controller 90 is provided, which controls pressure regulation valve 60 for setting an intended fuel pressure in common fuel lines 95, 100, 85. Moreover, controller 90 controls four fuel injectors 10, 15, 20, 25 with respect to a predefined opening time and a predefined open duration, in order to inject an intended fuel quantity into the cylinders in an intended time window. This takes place in a suitable manner for setting a torque intended by the driver, predefined via an acceleration pedal of the vehicle, or for setting a predefined air/fuel mixture ratio. A pressure sensor 55 is situated in at least one of high pressure lines 65, 70, 75, 80, which sensor measures the fuel pressure in this high pressure line and conveys the measuring result to controller 90. Pressure sensor 55 is situated in the area of the assigned fuel injector. As described in published German patent document DE 102 17 592, for example, the pressure sensor may be identical with a piezoelectric actuator which may be provided in an example as a control element for opening and closing the nozzle of the respective fuel injector. In the example in FIG. 1, pressure sensor 55 is situated in first high pressure line 65 in the area of first fuel injector 10. The time signal of the pressure characteristic, detected by the pressure sensor, is conveyed to controller 90. In a similar manner, one or several of high pressure lines 70, 75, 80 may each be equipped with a pressure sensor and a signal line to controller 90.

Fuel supply system 5 shown in FIG. 1 represents what is known as a common rail injection system. As described, rail 85 represents a high pressure fuel storage. Using pressure regulation valve 60, the fuel in rail 85 is set to a predefined pressure. The predefined pressure may suitably be calibrated on a test bench, for example. Each injection of fuel into the combustion chamber of the engine via fuel injectors 10, 15, 20, 25 causes a slight pressure drop in rail 85. In order to maintain the predefined pressure in rail 85, an appropriate fuel quantity is re-supplied to rail 85 by high pressure pump 40. The pressure in rail 85, necessary for this purpose, is regulated optionally via pressure regulation valve 60 or via an adjustable throttle point (not shown in FIG. 1) of, for example, the fuel metering unit at a fuel inlet of high pressure pump 40 from the fuel tank (not shown in FIG. 1). In conventional fuel supply systems, the pressure to be adjusted is measured by a rail pressure sensor which is situated directly on rail 85.

Since rail 85 has a relatively large volume in comparison with the connected high pressure lines 65, 70, 75, 80 and the high pressure bores (not shown in FIG. 1) within the individual fuel injectors 10, 15, 20, 25, the rail inner diameter is much greater than the line inner diameter of high pressure lines 65, 70, 75, 80 and the high pressure bores, and high-frequency pressure oscillations which occur in high pressure lines 65, 70, 75, 80 and in fuel injectors 10, 15, 20, 25 during injection of the fuel are dampened by the rail volume. These high-frequency oscillations, whose frequencies lie approximately between 1 kHz and 3 kHz, for example, thus may not be detected by the rail pressure sensor. Only the pressure increases caused by the delivery strokes of high pressure pump 40 and the pressure drops due to the removal of fuel during the injection of fuel into the cylinders via fuel injectors 10, 15, 20, 25 may be detected by the rail pressure sensor.

The present invention thus provides for the pressure sensor to be relocated to a position in which the low-frequency pressure fluctuations due to the fuel supply by high pressure pump 40 and the fuel removal due to the injection, necessary for the regulation of the fuel pressure in rail 85, as well as the previously undetectable high-frequency pressure oscillations between the nozzle of the respective fuel injector and the end of the associated high pressure line facing rail 85, are measurable, the high-frequency pressure oscillations being caused by the injection operation itself. Suitable signal processing of the measured pressure signal makes it possible to separate the high-frequency and low-frequency components, so that a single sensor may be used for the rail pressure regulation and the measurement of the high-frequency pressure oscillation in the appropriate high pressure line. This results in substantial cost savings in comparison to a system having two separate pressure sensors which are specialized, e.g., with regard to their position in fuel supply system 5, one in the rail pressure regulation and the other in the measurement of the high-frequency pressure oscillation of the associated high pressure line.

According to the present invention, pressure sensor 55 is situated in the area of first fuel injector 10. As shown in FIG. 1, pressure sensor 55 may be situated at one end of first high pressure line 65 facing first fuel injector 10. As described in published German patent document DE 102 17 592, pressure sensor 55 may also correspond to a piezoelectric actuator as a control element of first fuel injector 10 and may utilize the piezoelectric actuator's sensor effect as described in published German patent document DE 102 17 592. For detecting the high-frequency pressure fluctuations in second high pressure line 70, in third high pressure line 75, and in fourth high pressure line 80, a pressure sensor may also be situated in a corresponding manner in the area of the associated fuel injector, the pressure signal of the pressure sensor being conveyed to controller 90 in an appropriate manner and analyzed there. However, this procedure is described in the following as an example for pressure sensor 55 and first high pressure line 65.

The relocation of pressure sensor 55 from rail 85 to a position near the injector on one of the available high pressure lines 65, 70, 75, 80 results in the detection of the high-frequency pressure oscillation in the high pressure line, on which pressure sensor 55 is situated, in addition to the low-frequency pressure fluctuations due to the pump supply of high pressure pump 40 and the fuel removal due to the injection of one or several of fuel injectors 10, 15, 20, 25, the high-frequency pressure oscillation being caused by the injection operation of the associated fuel injector. In the present example, the high-frequency pressure oscillation in first high pressure line 65, which is caused by the injection operation of first fuel injector 10, is detected by pressure sensor 55 situated on first high pressure line 65.

Figure 2:
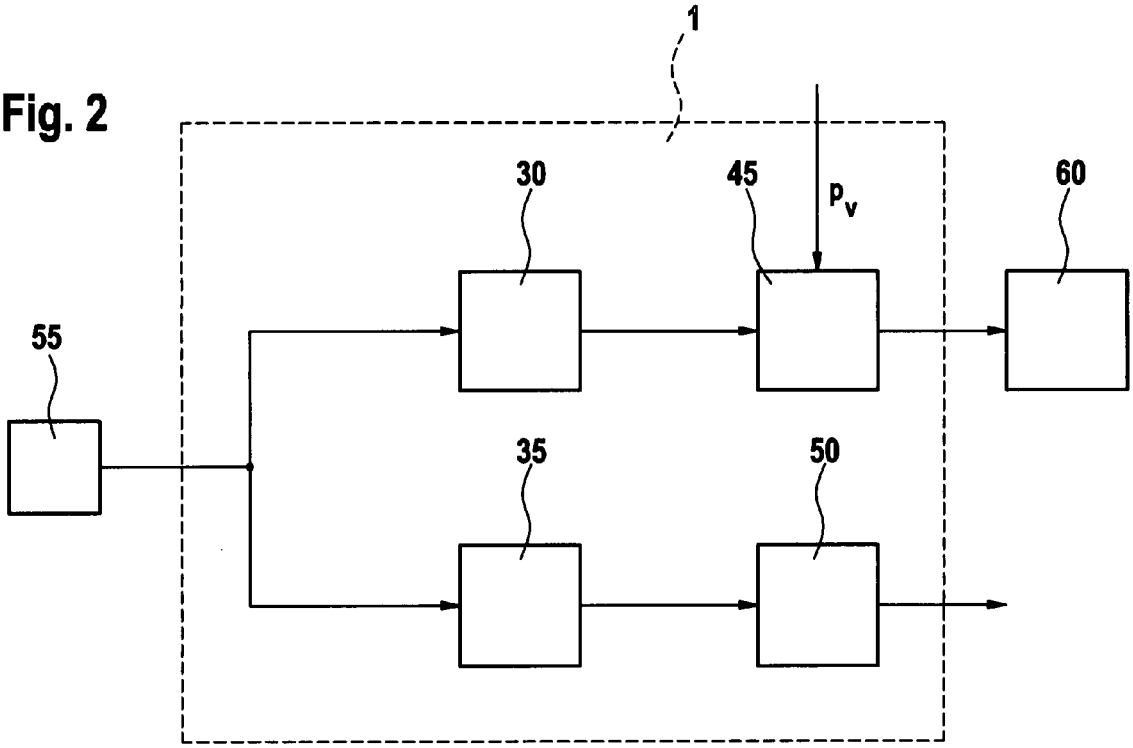
FIG. 2 shows a block diagram for illustrating an example embodiment of the device, as well as the corresponding method, according to the present invention.

Since the above-described effects occur in different frequency spectra, separation of the low-frequency pressure fluctuations from the high-frequency pressure fluctuations, which are contained in the signal of pressure sensor 55, is possible using suitable filtering. A corresponding device according to the present invention for determining different pressure fluctuations in the signal of pressure sensor 55 is indicated in FIG. 2 by reference numeral 1 and may be implemented in controller 90 in the form of software and/or hardware. Device 1 includes a first filter 30 and a second filter 35, to which the signal of pressure sensor 55 is conveyed. First filter 30 has a first filter characteristic and second filter 35 has a second filter characteristic. The first filter characteristic is different from the second filter characteristic. In the present example, the two filter characteristics are formed by different, in particular, but not necessarily, non-overlapping pass-bands. A first limiting frequency of first filter 30 is selected in such a way that it is higher than the first frequencies of low-frequency pressure fluctuations to be anticipated caused by the fuel supply by high pressure pump 40 and/or low-frequency pressure fluctuations to be anticipated due to the fuel removal during at least one injection operation of one of fuel injectors 10, 15, 25. A pass-band of first filter 30 below the first limiting frequency is selected in such a way that it includes the first frequencies. First filter 30 may be designed as a band-pass filter, for example; a third limiting frequency for the pass-band of first filter 30 must then also be defined in such a way that it lies below the above-mentioned first frequencies. It is even simpler to design first filter 30 as a low-pass filter, so that the third limiting frequency no longer has to be defined. A signal is applied to the output of first filter 30 which includes only the pressure fluctuations having the first frequencies and from which the high-frequency pressure fluctuations due to the injection operation of first fuel injector 10 have been filtered out and are thus no longer present. As shown in FIG. 2, for example, this output signal of first filter 30 may then be conveyed to a processing unit which is characterized in the example of FIG. 2 as a control unit 45. Control unit 45 is used for regulating the pressure in rail 85 to a predefined pressure value $P_v$, which is conveyed to control unit 45 in addition to the output signal of first filter 30. Control unit 45 subsequently forms the difference between predefined pressure value $P_v$ and the output signal of first filter 30 as the actual value of the rail pressure. Control unit 45 then generates a control signal for the pressure regulating valve 60 in such a way that this difference is minimized and the low-frequency pressure fluctuations due to the fuel supply by high pressure pump 40 and/or due to the pressure drop during removal of fuel by one or several of fuel injectors 10, 15, 20, 25 are largely compensated.

A limiting frequency of second filter 35 is selected in such a way that it is lower than a second frequency or second frequencies of the high-frequency pressure fluctuations to be anticipated which occur during an injection operation of first fuel injector 10. A pass-band of second filter 35 above the second limiting frequency is selected in such a way that it includes the second frequency or the second frequencies. Second filter 35 may also be designed as a band-pass filter which closes the pass-band of second filter 35 upward by a fourth limiting frequency which is higher than the second frequency or the second frequencies. The second limiting frequency, for example, may be selected to be slightly lower than or equal to 1 kHz, e.g., 900 Hz, and the fourth limiting frequency, for example, may be selected to be slightly over 3 kHz, e.g., 3.1 kHz. Second filter 35 may be implemented even more simply as a high-pass filter; in this case, the fourth limiting frequency no longer has to be defined. Since the first frequencies are lower than the second frequency or second frequencies, the first limiting frequency and the second limiting frequency should lie between the first frequencies and the second frequency or second frequencies, in order to be able to cleanly separate the first frequencies from the second frequency or second frequencies. The first limiting frequency may be selected to be equal to the second limiting frequency. In order to reliably separate the different frequency spectra it is also advantageous to select the second limiting frequency to be higher than the first limiting frequency. However, the second limiting frequency may also be selected to be lower than the first limiting frequency, in which case the pass-bands of the two filters 30, 35 overlap. In the present example, the first and the second limiting frequencies may also be selected to be 1 kHz each. Thus, the signal at the output of second filter 35 is cleared of the low-frequency pressure fluctuations of the output signal of pressure sensor 55 and only includes the high-frequency pressure fluctuations due to the injection operation of first fuel injector 10. The output signal of second filter 35 may then be conveyed for suitable further processing. This may be characterized, as shown in FIG. 2 as an example, by a determination unit 50 which determines the frequency of the high-frequency pressure oscillation from the output signal of second filter 35, by way of a Fourier analysis, for example. The frequency of the high-frequency pressure oscillation in first high pressure line 65 is directly proportional to the sound velocity of the fuel, so that, after determining the proportionality constant on a test bench, for example, and its storage in a memory assigned to determination unit 50, the sound velocity of the fuel in first high pressure line 65 may be calculated with the aid of this proportionality constant and the determined frequency of the high-frequency pressure oscillation. The determined sound velocity may then in turn be conveyed to further processing by determination unit 50, it being possible that this further processing takes place in controller 90 or in a different control unit.

Injection quantity errors may occur due to the high-frequency pressure fluctuations in first high pressure line 65 and first fuel injector (10), since injection via nozzle 105 of first fuel injector 10 takes place at a time at which the pressure wave of a previous injection of first fuel injector 10 has not yet decayed. However, if this pressure wave, which corresponds to the described high-frequency pressure fluctuation between nozzle 105 of first fuel injector 10 and the rail-side end of first high pressure line 65, is known, i.e., in the form of the output signal of second filter 35, a suitable injection quantity correction may be carried out as a function of the output signal of second filter 35 which takes the pressure wave of the previous injection of first fuel injector 10 into account. However, the exact implementation of such further processing of the output signal of second filter 35 is not critical to the present invention. Such an injection quantity correction makes it possible to increase the metering accuracy of the fuel supply system.

The described high-frequency pressure oscillation in first high pressure line 65 and first fuel injector 10 is a hydraulic oscillation which has its maximum pressure amplitude at the closed nozzle 105 of first fuel injector 10; its pressure amplitude at the rail-side open end of first high pressure line 65, however, is very low. Therefore, this high-frequency oscillation cannot be detected by a conventional pressure sensor within rail 85. This is achieved in the described manner by placement of pressure sensor 55 in first high pressure line 65 near the injector. Although pressure sensor 55 is no longer situated in the area of rail 85, it is nevertheless possible to reconstruct the pressure characteristic in rail 85 from the measured pressure of pressure sensor 55 in first high pressure line 65 with great accuracy. The level of the pressure peaks of the low-frequency pressure signal, in particular, which are used for regulating the rail pressure, differ only marginally from the level of the pressure peaks of the pressure signal which was measured directly in rail 85 for test purposes and was filtered with the aid of filter 30. Regulation of the rail pressure is thus possible without any accuracy losses by using the filtered pressure signal determined by pressure sensor 55, situated near the injector in first high pressure line 65. The method and the device according to the present invention have been described based on the pressure signal provided by pressure sensor 55. The pressure fluctuations may generally be determined by appropriately analyzing a signal, which is characteristic for the pressure in the area of first fuel injector 10, this signal being formed by a sensor or it may be modeled from performance quantities of the fuel supply system and/or the internal combustion engine which is supplied with fuel by fuel supply system 5. The pressure signal of pressure sensor 55 has been analyzed in the present example as the signal characteristic for the pressure in the area of first fuel injector 10. However, a signal which is proportional to pressure, e.g., the oscillation amplitude of the diaphragm of a pressure sensor, could also be used.

According to FIG. 2, device 1 according to the present invention includes first filter 30, second filter 35, control unit 45, and determination unit 50. In addition, device 1 may alternatively also include pressure sensor 55 and/or pressure regulation valve 60. However, device 1 should essentially include at least the first filter 30 and second filter 35 so that, in a further alternative, device 1 may include only first filter 30 and second filter 35. Predefined pressure PV may be provided from a memory (not shown in FIG. 2); this memory may be associated with controller 90 and may be situated inside or outside of device 1. It may be assumed in the present example that this memory is situated outside of device 1.

What is claimed is:

1. A device for determining pressure fluctuations in a fuel supply system, comprising:

a first filter for receiving and filtering a signal characterizing a pressure in the area of a first fuel injector of the fuel supply system; and a second filter for receiving and filtering the signal characterizing the pressure in the area of the first fuel injector;

wherein the first filter has a first filter characteristic and the second filter has a second filter characteristic which differs from the first filter characteristic.

2. The device as recited in claim 1, wherein the first filter is configured as one of a low-pass filter and a band-pass filter.

3. The device as recited in claim 2, wherein the second filter is configured as one of a high-pass filter and a band-pass filter.

4. The device as recited in claim 3, wherein a first limiting frequency of the first filter is selected such that the first limiting frequency is higher than at least one first frequency of at least one of: a) low-frequency pressure fluctuations caused by a fuel delivery by a fuel pump; and b) low-frequency pressure fluctuations caused by a pressure drop during at least one injection operation, and wherein a pass-band of the first filter is selected to be below the first limiting frequency and includes the at least one first frequency.

5. The device as recited in claim 4, wherein a second limiting frequency of the second filter is selected such that the second limiting frequency is lower than at least one second frequency of high-frequency pressure fluctuations occurring during an injection operation of the first fuel injector, and wherein a pass-band of the second filter is selected to be above the second limiting frequency and includes the at least one second frequency.

6. The device as recited in claim 4, further comprising:

a control unit operatively coupled to the first filter, wherein the control unit receives a first output signal of the first filter and regulates the pressure in a fuel line of the fuel supply system as a function of the first output signal.

7. The device as recited in claim 5, further comprising:

a control unit operatively coupled to the first filter, wherein the control unit receives a first output signal of the first filter and regulates the pressure in a fuel line of the fuel supply system as a function of the first output signal.

8. The device as recited in claim 4, further comprising:

a determination unit operatively coupled to the second filter, wherein the determination unit receives a second output signal of the second filter and determines a sound velocity of the fuel in a fuel line of the fuel system as a function of the second output signal.

9. The device as recited in claim 5, further comprising:

a determination unit operatively coupled to the second filter, wherein the determination unit receives a second output signal of the second filter and determines a sound velocity of the fuel in a fuel line of the fuel system as a function of the second output signal.

10. The device as recited in claim 4, wherein the signal characterizing a pressure in the area of the first fuel injector is generated by at least one sensor situated in the area of the first fuel injector.

11. The device as recited in claim 5, wherein the signal characterizing a pressure in the area of the first fuel injector is generated by at least one sensor situated in the area of the first fuel injector.

12. A method for determining pressure fluctuations in a fuel supply system, comprising:

generating, using a sensor, a signal characterizing a pressure in the area of a first fuel injector of the fuel supply system;

filtering the signal characterizing the pressure in the area of the first fuel injector using a first filter, wherein the first filter has a first filter characteristic; and filtering the signal characterizing the pressure in the area of the first fuel injector using a second filter, wherein the second filter has a second filter characteristic which differs from the first filter characteristic.

* * * * *